United States Patent [19]

Matsuo et al.

[11] 4,271,967

[45] Jun. 9, 1981

[54] SYSTEM FOR SORTING ELONGATED MEMBERS

[75] Inventors: Osamu Matsuo; Keijiro Nakamura; Toshimi Kodaira, all of Kawasaki, Japan

[73] Assignee: Fuji Electric Co., Ltd., Kawasaki, Japan

[21] Appl. No.: 16,692

[22] Filed: Feb. 28, 1979

[30] Foreign Application Priority Data

Mar. 1, 1978 [JP] Japan ..... 53-23215
Mar. 1, 1978 [JP] Japan ..... 53-23216

[51] Int. Cl.[3] ..... B07C 5/04

[52] U.S. Cl. ..... 209/558; 209/586; 209/698; 250/223 R; 250/560; 356/383; 356/384

[58] Field of Search ..... 209/509, 552, 558, 576, 209/577, 586, 698, 912, 939; 356/383, 384, 385; 250/223 R, 560, 561

[56] References Cited

U.S. PATENT DOCUMENTS

| | | | |
|---|---|---|---|
| 3,089,594 | 5/1963 | Early | 209/525 |
| 3,224,322 | 12/1965 | Westbrook | 209/939 X |
| 3,774,040 | 11/1973 | Stephanos | 209/586 X |
| 3,977,524 | 8/1976 | Boots | 209/912 |
| 4,146,134 | 3/1979 | Keen et al. | 209/698 |

*Primary Examiner*—Joseph J. Rolla
*Attorney, Agent, or Firm*—Sughrue, Rothwell, Mion, Zinn and Macpeak

[57] ABSTRACT

A system of sorting elongated pieces such as asparagus, wherein each of the elongated pieces are successively conveyed by a conveyer and detected as a still image by a sensor such as a TV camera. In processing a signal representative of the still image a stem diameter of the piece and a ratio of the spike maximum diameter of the piece to the stem diameter are obtained as sorting out factors by calculation. When the calculation values of the sorting out factors satisfy predetermined reference values, the piece is further sorted out according to size. The stem diameter is measured at a position which is spaced from the cut end of the stem by a predetermined dimension toward the spike thereof.

38 Claims, 15 Drawing Figures

LOK
AD22
FF7
FF8
PH1R
AD20
AD21
FF5
FF6
114
C1,C2
CK1
AD18
EX17
EX18
EX19
EX20
EX21
EX22
EX23
EX24
EX25
EX26
EX27
EX28
D5
D6
D7
112
AD17
LA
EX9
EX10
EX11
EX12
EX13
EX14
EX15
EX16
D3
D4
111
AD19
EX19
D8
113
110
CK
QA
QB
QC
QD
CY
CL-1
E
CL
AD30
HSY
VIDEO
C30
C20
C30
VMSKR

SYSTEM FOR SORTING ELONGATED MEMBERS

BACKGROUND OF THE INVENTION

This invention relates to a system for sorting elongated members in which the pieces are successively conveyed by a conveyor means are detected as still images by an industrial television camera, and the image signal of the television camera is processed to determine whether each piece is an acceptable one or an unacceptable one and to sort out each piece according to the size. Typical pieces are vegetables such as asparagus, celery, mushrooms, carrots, and the like. The invention will be described with respect to asparagus, but is not so limited in utility.

For agricultural products such as asparagus, it is necessary to sort a large number in a short period of time to keep them fresh. However, heretofore a large number of pieces of asparagus are visually inspected by an inspector to sort them. Since the speed at which the inspector visually inspects pieces of asparagus conveyed by the conveyer is limited, it is difficult to visually inspect a large number of pieces of asparagus in a short time. Furthermore, since there are individual variations in sorting criteria among inspectors, different inspectors may have different inspection standards. Therefore it is difficult to inspect all of pieces of asparagus according to the same inspection standard. In order to eliminate the above-described inspection errors, it is necessary to provide inspectors who can inspect according to one and the same inspection standard. However, it is not practical such subjective judgements must be made.

In order to eliminate the above-described difficulties accompanying the conventional visual inspection performed by human inspectors, a method may be considered in which a detector such as a photo sensor and a limit switch is employed to measure asparagus length and asparagus stem diameter. However, in this method, if the detector is fixedly provided, each piece of asparagus to be conveyed by the conveyer means must be placed at a predetermined position on the conveyer. For this purpose, the conveyer must be designed so that pieces of asparagus are placed correctly at the predetermined positions on the conveyer means, then conveyed, and detected by the detector. Thus, the method is disadvantageous in that the design of a suitable conveyer is exceptionally difficult.

SUMMARY OF THE INVENTION

Accordingly, an object of this invention is to provide a system which can sort out in contactless mode and in a short time elongated pieces being conveyed successively by a conveyer.

It is another object of this invention to provide apparatus for sorting elongated pieces such as vegetables without contact while on a conveyer.

Yet another object of this invention is to provide a method by which elongated pieces such as vegetables can be sorted while on a conveyer without contact.

A further object of this invention is to provide a system that sorts vegetables accurately without contact in a real time manner while the vegetables are moving on a conveyer.

In sorting out pieces of vegetables such as asparagus according to the invention, a stem diameter, asparagus length, and the ratio of a spike maximum diameter to a stem diameter are calculated (measured), and each piece of asparagus is sorted out according to the stem diameter. The inspection of the stem diameter, one of the factors for sorting out pieces of asparagus, is carried out by measuring the diameter of an asparagus stem at its position which is separated by a predetermined value from the cut end of the stem toward the spike. Since the asparagus stem is cut close to its root, the outer surface of the cut end portion may be considerably deformed, or the asparagus stem may be cut obliquely. Thus, if the stem diameter is measured at the cut end, the measurement involves a number of irregular factors which may affect the sorting out operation. Accordingly, the above-described measurement is preferable to eliminate such irregular factors.

For the following reason, the ratio of the stem diameter to the spike maximum diameter is inspected. It is desirable that the stem diameter be in proper balance with the spike maximum diameter. However, the piece of asparagus whose spike is open may be mixed in a number of pieces of asparagus being conveyed. Therefore, if the size selection is carried out merely by measuring the spike maximum diameter, unacceptable asparagus may be mixed in the pieces of asparagus to be sorted out. Accordingly, if the ratio of the stem diameter to the spike maximum diameter is inspected to determine whether or not the stem diameter is in balance with the spike maximum diameter, then a piece of asparagus whose spike is open can be rejected.

The asparagus length, the last of the size selection factors, is inspected to determine if it is longer than the minimum allowable length and is shorter than the maximum allowable length. That is, the decision of the asparagus length is made whether or not it is within the allowable range from the maximum allowable length to the minimum allowable length.

If pieces of asparagus are determined as acceptable based on the results of the above-described measurements and calculations for the three selection factors, then they are further sorted out into large, medium, small, very small and unacceptable pieces according to the stem diameters.

This invention will be described with respect to the accompanying drawings and the description of the preferred embodiment that follows.

BRIEF DESCRIPTION OF THE DRAWINGS

FIG. 7 is a diagram of the calculation circuit for determining stem diameter;

FIG. 8 is a diagram of the calculation circuit for determining the length of the elongated member;

FIG. 9 is a diagram of the circuit to calculate spike maximum diameter;

FIG. 10 is a diagram of the circuit for calculating the ratio of the spike maximum diameter to stem diameter.

DESCRIPTION OF THE PREFERRED EMBODIMENTS

One preferred embodiment of this invention will now be described with reference to the accompanying drawings in detail.

Figure 1:
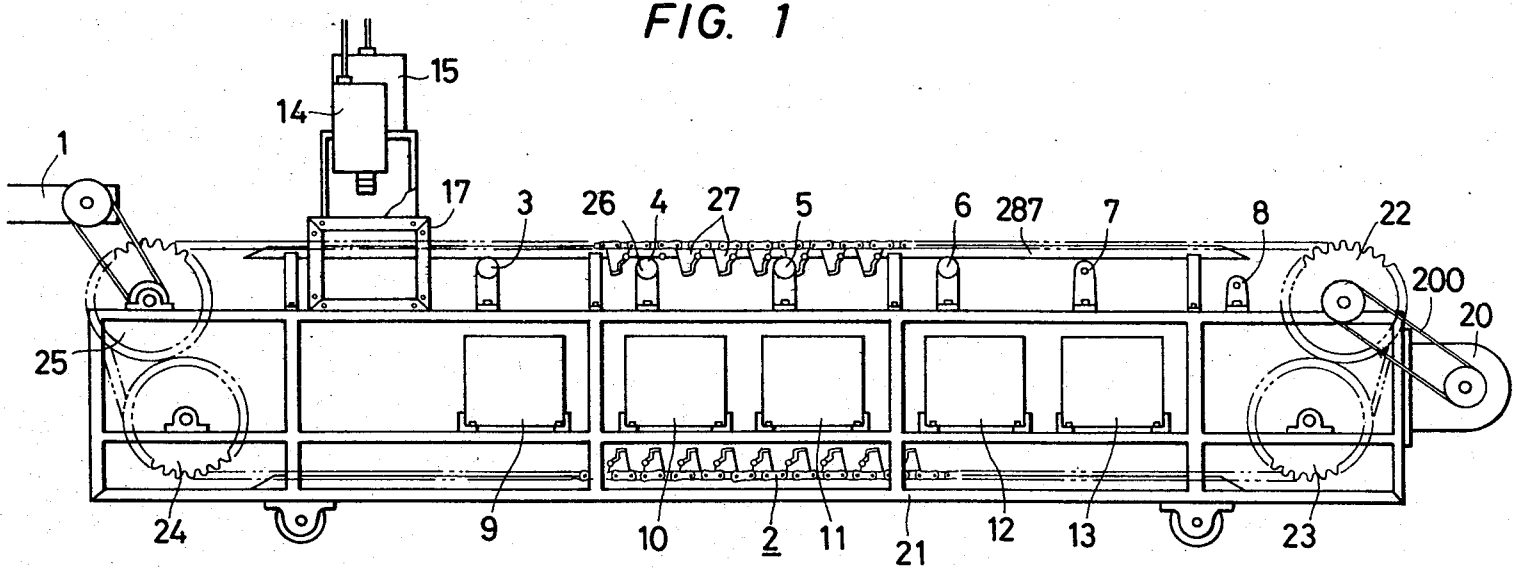
FIG. 1 is a front view of a conveyer means.

In FIG. 1, reference numeral 1 designates a supplying machine for supplying pieces of vegetables such as asparagus to a conveyer device 2. In the conveyer device 2, a conveying body 26 for conveying pieces of asparagus is laid over gears 22 through 25 which are supported on a mounting stand 21 and driven by a motor 20. Containers 27 for containing pieces of asparagus are mounted on the conveying body 26 at predetermined intervals. The container 27 is designed so that its bottom plate can be opened. Rotary solenoids 3, 4, 5 and 6, opening and closing control mechanisms have control cams 31, 41, 51 and 61 for opening to bottom plates of the containers 27. They are arranged along the conveying body 26.

Sorting boxes 9 through 12 for retaining pieces of asparagus falling from the containers 27 are disposed at positions corresponding to the positions of the rotary solenoids 3, 4, 5 and 6, respectively. Provided behind the rotary solenoid (as viewed along the movement direction of the conveying body 26) is a control piece 7 adapted to be an opening and closing control mechanism for opening the bottom plates of the containers 27. A sorting box 13 is provided at a position corresponding to the position of the control piece 7. The bottom plates of the containers 27 passing through the position of the control piece 7 are opened by the rotary solenoids 3, 4, 5 or 6 or the control piece 7. The bottom plates of the containers 27 thus opened are closed by a setting bar 8 which is fixedly disposed behind the control piece 7.

Provided above the conveying body 26 is an industrial television camera 14 and an irradiation source 15 which are fixedly mounted on a mounting base 17. The pieces of asparagus in the containers 27 on the conveying body 26 are provided as stationary images on the industrial television camera by momentarily lighting by the irradiation source 15.

Figure 2:
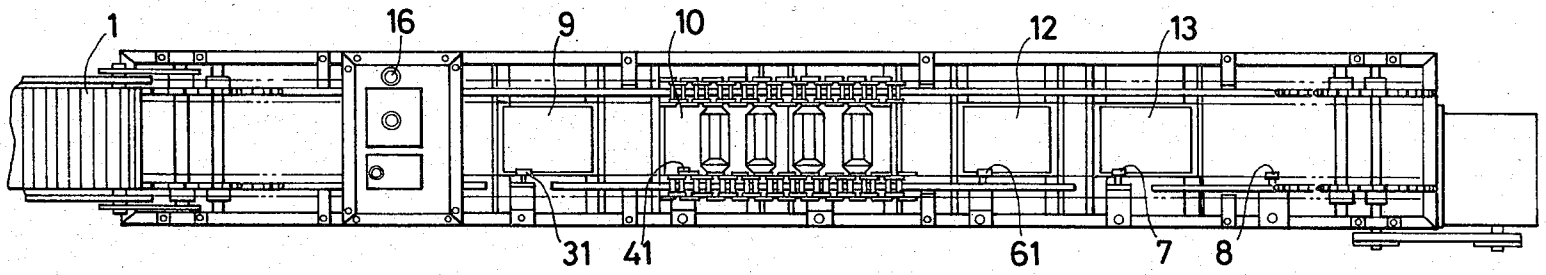
FIG. 2 is a plan view of the conveyer means shown in FIG. 1.

In FIG. 2, reference numeral 16 designates a photoelectric switch. A light emission diode and a photo-transistor are disposed so that they confront with the photoelectric switch 16 through the conveying body 26. The photoelectric switch 16 is used as a detector for detecting the position of the conveying body 26. When a container 26 reaches a position where it is within the view angle the television camera 14, the detector outputs a substance arrival signal a momentarily turn on the irradiation source 15.

A decision device (not shown) is further provided which operates to control the lighting of the irradiation source 15 in response to the substance arrival signal from the photoelectric switch 16 and to convert the image signal of the industrial television camera 14 into binary data thereby to decide the selection of size, as described in detail later.

Figure 3:
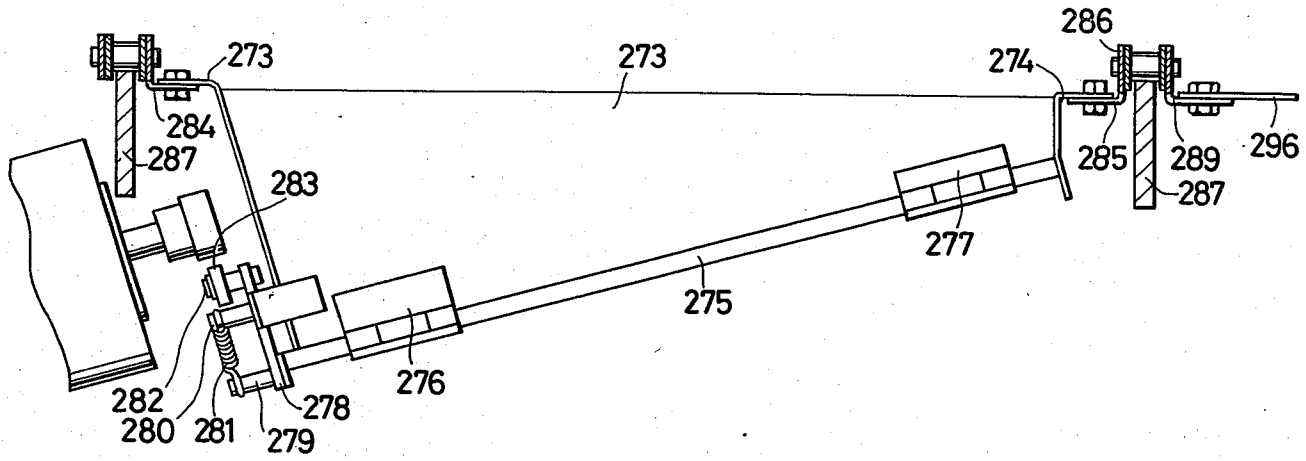
FIG. 3 is a side view showing a container carried by the conveyer means.
Figure 4:
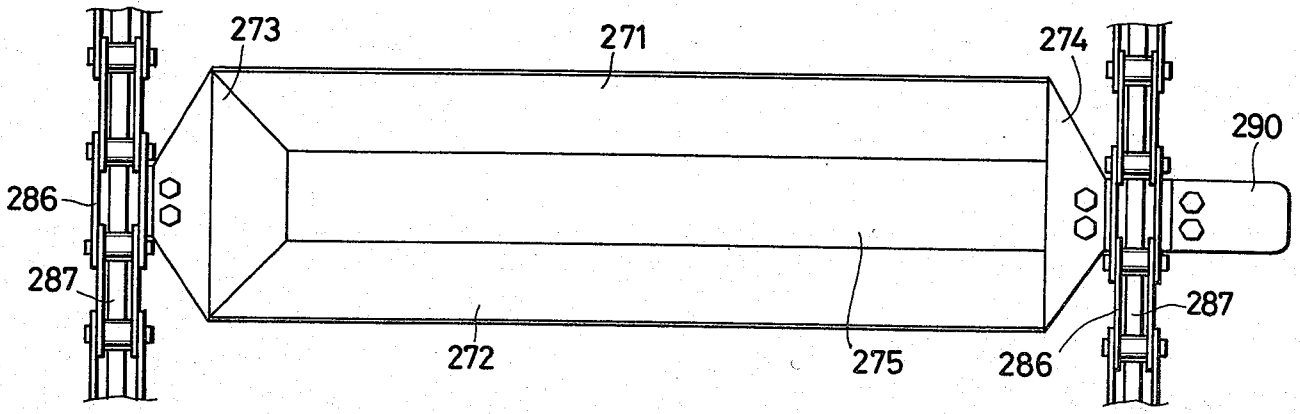
FIG. 4 is a plan view showing the container shown in FIG. 3.

The containers 27 mounted on the conveying body 26 are constructed as shown in FIGS. 3 and 4. More specifically, the container 27 is made up of side plates 271 through 274 and a bottom plate 275. The container 27 is in the form of a trapezoid which converges from its upper opening toward the lower bottom. The bottom plate 275 is coupled to the container 27 by means of hinges 276 and 277 so that it can be opened and closed turning around the pins of the hinges. A lever 278 is fixedly secured to the side of the bottom plate 275, and is provided with a pin 275. This pin 275 is associated with a pin 280 fixedly mounted on the side plate 272 through a pulling spring 281 so that the bottom plate 275 is maintained in open state or in closed state by means of the pulling spring 281.

Figure 5:
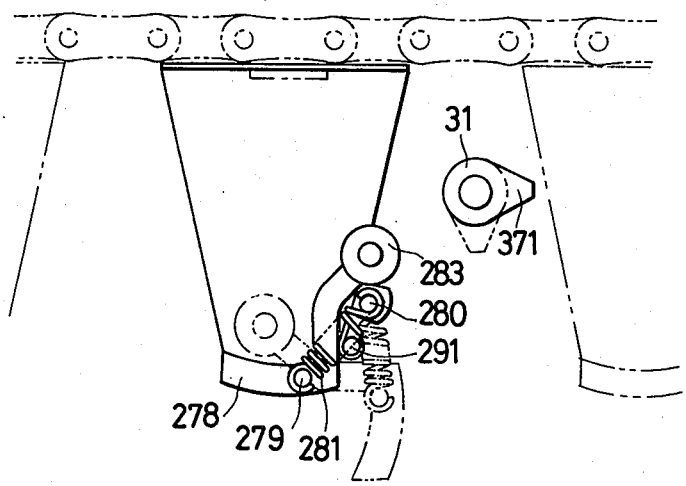
FIG. 5 is a front view of the container.

The open and closed states of the bottom plate 275 are as shown in FIG. 5. In FIG. 5, the pulling spring 281 maintains the bottom plate 275 in the closed state at the position indicated by the solid line and in the open state at the position indicated by the dotted line. A sponge rubber member 283 secured by a pin 282 is provided on one end of the lever 278 fixedly secured to the side of the bottom plate 275. The sponge rubber member 283 is disposed so that it will confront the cams 31, 41, 51 and 61 of the rotary solenoids 3 through 6 or the control bar 7 and the setting bar 8.

The bottom plate 275 of the container 27 is tilted in such a manner that the side plate 273 is at the lower position. Hence one end of pieces of asparagus are aligned along the side plate 273 of the container 27. The end portions of the side plates 273 and 274 are fixedly secured to mounting members 284 and 285 with bolts. The mounting members are fixedly secured to the chain forming members 286 of the conveying body 26 which are moved along rails 287 and 287. The side plate 274 uses a photoelectric switch shading plate 290 provided through a mounting member 289 at the opposite side of the chain forming member 286 of the mounting member 285. This photoelectric switch shading plate 290 is utilized to shade light from light emission diode by passing between the light emission diode and the photo-transistor of the photoelectric switch 16 shown in FIG. 2.

The inside surfaces of the side plates 271 through 274 and the bottom plate 275 of the container 27 are coated with a block semigloss paint. This will highlight or show the asparagus clearly. Since the bottom plate 275 of the container is tilted, the industrial television camera 14 is also tilted so that its image pickup surface is parallel with the bottom plate 275. However, the television camera 14 is not tilted in FIGS. 1 and 2 for convenience in description.

The operation of the apparatus thus constructed will be described. When a driving force is transmitted from the motor 20 through a belt 200 to the gear 22, the conveying body 26 is rotated clockwise. In synchronization with the rotating speed of the conveying body 26, pieces of asparagus are supplied one by one into the containers 27 of the conveying body 26 from the asparagus supplying machine 1. In this case, the pieces of asparagus are supplied into the containers in such a manner that the asparagus spike is aligned with the side plate 273 of each container 27. As the conveying body 26 moves, the photoelectric switch shading plate 290 of the container 27 shades light from the photoelectric switch 14.

Whenever the shading plate 290 passes through the photoelectric switch 16, the latter 16 outputs the substance arrival signal to momentarily turn on the irradiation source 15. As a result, the asparagus appears as a stationary image on the image pick-up surface of the television camera 14. At the same time, the television camera outputs a video signal to the decision device where the asparagus is sorted out according to the size as will be described later. The output of the decision device is carried out in a real time mode before the next container 27 reaches the position of the photoelectric switch 16, and the decision result as to the selection according to the size is stored in the decision device. The decision result stored in the decision device is applied to the rotary solenoids 3 through 6. Thus, when the asparagus subjected to the decision reaches the relevant rotary solenoid (3-6) according to the decision result, that rotary solenoid is energized.

For instance, it is assumed that the rotary solenoid 3 is energized. In this case, as shown in FIG. 5 in detail, the cam 31 is moved from the position indicated by the solid line to the position indicated by the dotted line. At that position, it stops at the position where the protrusion 311 of the cam 31 engages the sponge rubber member 283 of the lever 278 mounted on the bottom plate 275 of the container 27. After the energization of the rotary solenoid 3, the sponge rubber member 283 of the lever 278 is engaged with the protrusion 311 of the cam 31 to depress the sponge rubber member 283. As a result the lever 278 is turned counterclockwise around the pin 291 of the hinge 276.

As the lever 278 is turned in this manner, the bottom plate 275 of the container 27 is also turned around the pins 291 of the hinges 276 and 277. In this operation, the lever 278 is quickly turned to the position indicated by the dotted line by the elastic force of the pulling spring 281 after the sponge rubber member 283 is depressed by the protrusion 311 of the cam 31 until the pin 279 is moved to the line connecting the pin 280 and the pin 291 of the hinge 276.

Simultaneously when the lever 278 is turned, the bottom plate 275 of the container 27 is opened to allow the asparagus therein to drop into the sorting box 9 shown in FIG. 1. The rotary solenoid 3 is maintained energized until the pin 279 of the lever 278 (FIG. 5) reaches the line connecting the pin 280. Also, the pin 291 of the hinge 276 and the bottom plate 275 of the container 27 is held opened by the pulling spring 281. Thereafter, the rotary solenoid 3 is deenergized, and therefore the bottom plate of the following container 27 is not opened.

Similarly as in the above-described case, the bottom plates 275 of the containers 27 are opened by the other rotary solenoids. Therefore, the opening operations thereof will be omitted. The pieces of asparagus in the containers 27 are dropped into the respective sorting boxes 10 through 12 as the containers 27 are opened at the positions of the rotary solenoids 4 through 6, respectively. The container 27 whose bottom plate 275 is not opened by the rotary solenoid (3 through 6) because it contains a defective asparagus is moved to the position of the control bar 7 as the conveying body 26 is moved on. At that position, the sponge rubber 283 of the lever 278 fixedly secured to the bottom plate 275 is depressed by the control bar 7 to open the bottom plate 275. As a result, the defective asparagus is dropped into the sorting box 13 which is adapted to receive pieces of defective asparagus.

Thus, the pieces of asparagus supplied into the containers 27 by the asparagus supplying machine 1 are placed into respective sorting boxes 9 through 13 before they are conveyed to the position of the control bar 7. All of the bottom plates 275 of the containers 27 which have passed through the position of the control bar 7 have been opened. When these containers 27 reach the position of the setting bar 8, the bottom plates 275 engage the setting bar 8. The bottom plates 275 are depressed by the setting bar 8 and are thereby closed. Thereafter, the bottom plates 275 are maintained closed by the pulling spring 281.

Figure 6:
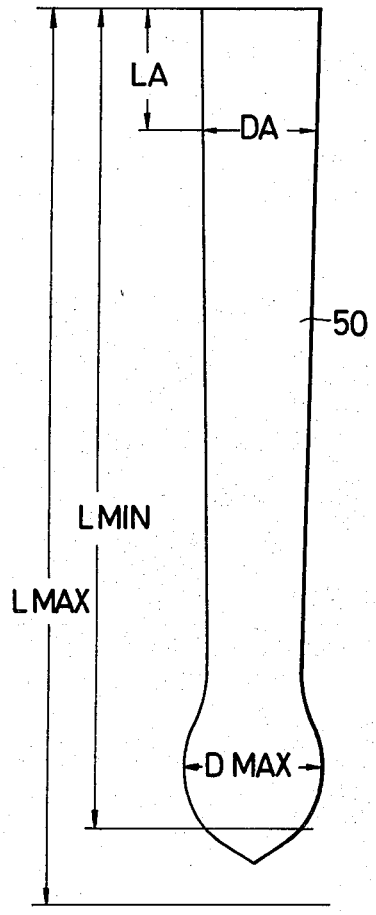
FIG. 6 is a explanatory diagram showing a piece of asparagus sorted out according to this invention.

The size selection of pieces of asparagus which are sorted out to be put in respective sorting boxes 9 through 13 is carried out according to the diameters of stems of asparagus, the ratios of the maximum diameters of spikes of asparagus to the diameters of stems, and the lengths. Referring now to FIG. 6 to determine the diameter of an asparagus stem, each piece of asparagus 50 is inspected for its diameter DA at its position a dimension LA from the cut end of the asparagus 50 (towards the spike). The diameter of the cut end of the step may be employed as the diameter to be inspected; however, because the cut end is very close to its root, the outer surface of that portion may be considerably deformed. Also, the stem may be obliquely cut. Thus, this method may involve a number of irregular factors and is therefore undesired. The above-described method of measuring the diameter DA of the stem at the position the dimension LA from the cut end of the stem is advantageous in eliminating these irregular factors.

The purpose of the inspection of the ratio of the maximum diameter DMAX of the spike of the asparagus 50 to the stem diameter DA is to eliminate the possibility that if size selection is carried out only according to the spike maximum diameter DMAX, asparagus which is to be sorted out as defective because its spike is open may be selected as acceptable. Stated differently, a defective asparagus whose spike is open can be rejected by inspecting whether the ratio of the spike maximum diameter DMAX to the stem diameter DA is in a suitable allowance range from the allowable lower limit KMIN to the allowable upper limit KMAX.

The defective asparagus which is too short or too long can be rejected by inspecting the length of the asparagus. The acceptable length of asparagus is determined by ascertaining whether or not the length of each asparagus is in an allowable length range from the allowable upper limit LMAX to the allowable lower limit LMIN.

The above-described stem diameter DA, the ratio of the spike maximum diameter DMAX to the stem diameter DA of asparagus 50 and length are inspected by means of the decision device using the industrial television camera as a sensor. All of the pieces of asparagus which have passed this inspection are further subjected to the size selection by opening the bottom plates of the containers by the rotary solenoids according to the stem diameters DA.

Figure 13:
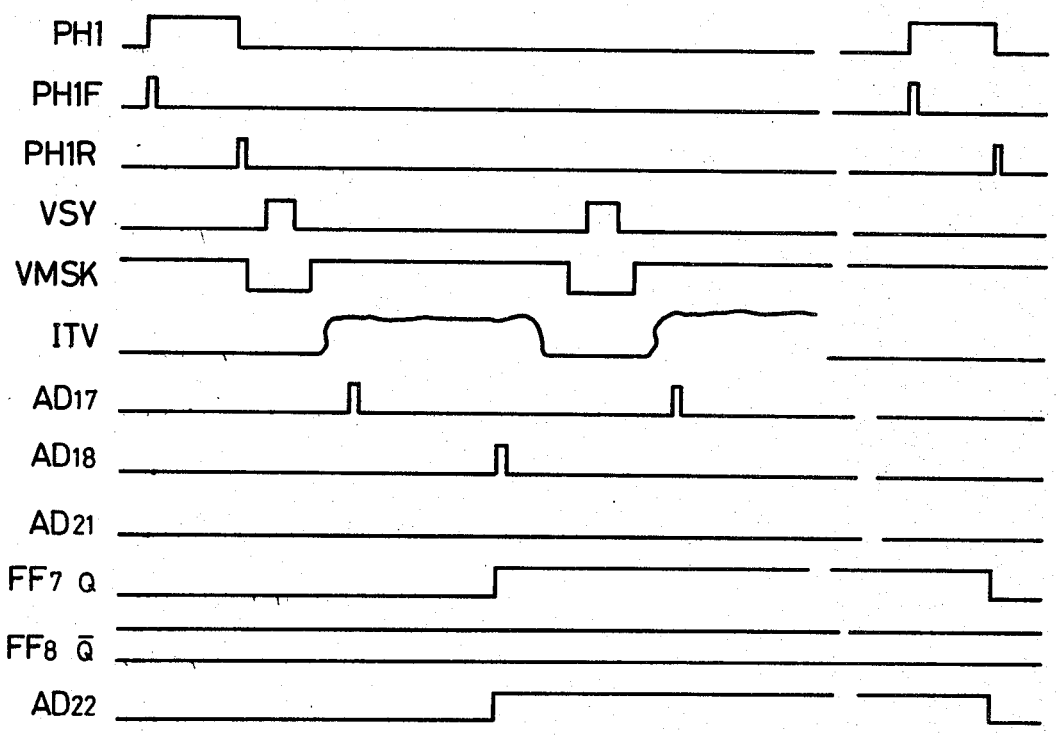

A circuit in which the stem diameter of each asparagus, the ratio of the spike maximum diameter to the stem diameter and the length are calculated to sorting out pieces of asparagus according to the size will now be described with reference to FIGS. 7 to 10. First, the procedure in which one piece of asparagus is sorted out according to the size will be described. The aririval of the asparagus is detected when the photoelectric switch plate 290 of the container 27 is detected by the photoelectric switch 16. The irradiation source 15 emits light in response to the detection signal of the photoelectric switch 16. In this operation, the light emission signal of the irradiation source 15, as shown by the waveform in FIG. 13, is synchronous with the first vertical drive signal VSY of the television camera 14 after the provision of the detection signal PH1 of the photoelectric switch 16.

The still image provided by the television camera 14 in response to the momentary irradiation of the irradiation means 15 is converted into binary data, with the background of the asparagus being a logical level "0" the asparagus itself a logical level "1". The still image is scanned in the logitudinal direction of the asparagus by the horizontal scanning lines and in the diametric direction by the clock pulses in the vertical scanning direction. The length of the asparagus is determined by counting the number of horizontal scanning lines, and the stem diameter and the spike maximum diameter are determined by counting the number of clock pulses. In accordance with the resulting totals, the rotary solenoids 3 through 6 are driven and the bottom plates 275 of the containers 27 are opened to receive the pieces of asparagus in the sorting boxes.

The above-described industrial television camera is typically an ITV camera with a one inch vidicon. In such a camera, a maximum of 240 horizontal scanning lines are available for one vertical scanning period, and an oscillator for dividing each horizontal scanning line with the clock pulse signal of 6 MHz. As a result, one image is divided into 240×320 picture elements. In this connection, if one picture element is made to be a square of 1 $mm^2$, setting and calculation described later can be readily achieved. Masks are provided at both ends of the horizontal scanning line in the television camera so that only one piece of asparagus is viewed by the television camera (that is, the preceding and succeeding pieces of asparagus are not taken by the television camera). This allows the processing of one piece of asparagus by one image.

If it is required to process a plurality of pieces of asparagus using one image, the masks may be removed from the television camera. In order to obtain the mask periods from the image in the television camera, the number of clock pulses dividing the horizontal scanning lines into 320 parts is counted by a counter which is reset every horizontal scanning line. Then the count output of the counter is utilized.

The circuitry for calculating the factors to sort out pieces of asparagus according to the size, namely, the stem diameter of asparagus, the length, and the ratio of the spike maximum diameter to the stem diameter, will be described.

Figure 7:
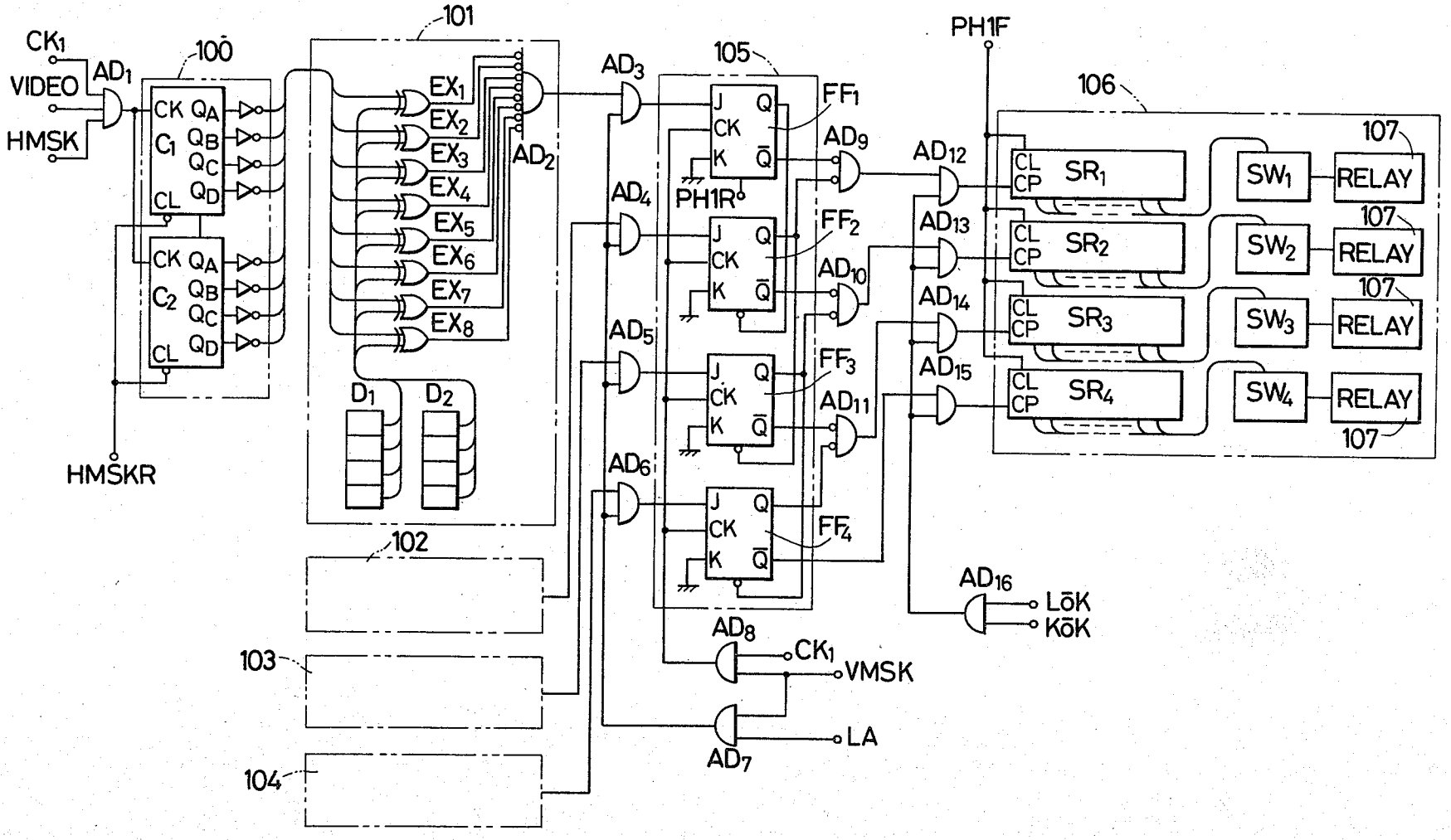
FIGS. 7 through 10 are circuit diagrams showing various circuits embodying the present invention.

The circuit for calculating the asparagus stem diameter is as shown in FIG. 7. In this figure, reference numeral 100 designates a counting circuit for the stem diameter and reference numerals 101 through 104 are coincidence circuits for detecting the coincidence between the count value of the counting circuit 100 and settings. A decision circuit 105 decides the size according to the outputs of the coincidence circuits 101 through 104. A memory circuit 106 stores the output of the decision circuit 105.

The counting circuit 100 comprises binary counters $C_1$ and $C_2$ which receive, as a count input, the output of an AND circuit $AD_1$. The counter $C_1$ forms decimal less significant digits, and the counter $C_2$ forms decimal significant digits. The AND circuit $AD_1$ receives, as inputs, a clock pulse $CK_1$ of 6 MHz as indicated by reference character $CK_1$ in FIG. 11. A logical signal VIDEO is obtained by converting the image signal of the television camera, as indicated by reference character ITV, into binary data (the asparagus being the logical level "1", the background thereof being the logical level "0"). A horizontal mask signal HMSK exists between a mask release signal HMSKF and a mask start signal HMSKR which indicates each horizontal scanning period in the television camera. Thus, the AND circuit $AD_1$ produces the clock pulse $CK_1$ obtained when the logical signal VIDEO is at the logical level "1" during the period of the horizontal mask signal HMSK. This output represents the diameter of the asparagus for every horizontal scanning period of the television camera.

The counters $C_1$ and $C_2$ whose clock pulse inputs CK are connected to the output of the AND circuit $AD_1$ count the diameter of the asparagus. The horizontal mask start signal HMSKR is applied to the clear inputs CL of the counters $C_1$ and $C_2$, so that the counters $C_1$ and $C_2$ are cleared for every horizontal scanning period completion. In the counting circuit 100, the clock pulse $CK_1$ at the logical level "1" binary-coded every horizontal scanning period is applied to the counter $C_1$ by the AND circuit $AD_1$, and the asparagus diameter is counted by the counters $C_1$ and $C_2$ every horizontal scanning period. The counters $C_1$ and $C_2$ provide an output of four binary digits $2^1$, $2^2$, $2^3$ and $2^4$, the output being applied to the coincidence circuits 101 through 104.

The coincidence circuit 101 is made up of setting devices $D_1$ and $D_2$, EXCLUSIVE OR circuits $Ex_1$ through $Ex_8$ (hereinafter referred to merely as $Ex_1$ through $Ex_8$ when applicable), and an AND circuit $AD_2$. The setting devices $D_1$ and $D_2$ operate to set the diameter of asparagus. In each setting device, four binary digits represent one decimal digit. The four bits of the setting device $D_1$ and the four bits of the setting device $D_2$ are applied to one input terminal of the respective $Ex_1$ through $Ex_8$, the other input terminals connected to the bits consisting of the four bits of the counter $C_1$ and the four bits of the counter $C_2$ in the counting circuit 100, respectively .

The AND circuit $AD_2$ receives signals obtained by inverting the outputs of the EXCLUSIVE OR circuits $Ex_1$ through $Ex_8$. In the coincidence circuit 101 thus organized, when the data set by the setting devices $D_1$ and $D_2$ coincides with the count value of the counters $C_1$ and $C_2$ in the counting circuit, the outputs of the $Ex_1$ through $Ex_8$ become the logical level "0" and the AND condition of the AND circuit $AD_2$ is satisfied. In other words, when the count value of the counters $C_1$ and $C_2$ coincides with the value set by the setting devices $D_1$ and $D_2$, the AND circuit $AD_2$ becomes conductive to output the logic "1". The other coincidence circuits 102 through 104 are equal in arrangement to the above-described coincidence circuit 101, and therefore they are not described in detail and are merely indicated by the one-dot chain lines.

The values set by the coincidence circuits 101 through 104 are, of course, different from each other to satisfy 101<102<103<104. If the count value of the counters $C_1$ and $C_2$ coincides with the value set by the coincidence circuit 104, then during that period the coincidence circuits 101 through 103 provide the concidence outputs respectively. In this example, the coincidence circuits 101, 102, 103 and 104 are provided for the smallest size, the small size, the medium size and the large size, respectively, so that pieces of asparagus can be sorted out according to that series of different size by the coincidence outputs of the coincidence circuits 101 through 104. It is apparent that more or less coincidence circuits may be used depending on sorting sensitivity and/or criteria.

The decision circuit 105 receiving the coincidence outputs of the coincidence circuits 101 through 104 is provided with four J-K flip-flops $FF_1$ through $FF_4$ (hereinafter referred to merely as $FF_1$ through $FF_4$ when applicable). The output terminals of AND circuits $AD_3$ through $AD_6$ are connected to the J input terminal of the flip-flops $FF_1$ through $FF_4$, respectively. The coincidence outputs of the coincidence circuits 101 through 104 are applied to one input terminal of the AND circuits $AD_3$ through $AD_6$. The other input terminals are connected to the output terminal of an AND circuit AD7. Accordingly, even if the coincidence circuits 101 through 104 provide the coincidence outputs the AND circuits $AD_3$ through $AD_6$ are not always rendered conductive; that is, the AND circuits $AD_3$ through $AD_6$ operate depending on the conduction state of the AND circuit $AD_7$.

In this connection, the conduction state of the AND circuit $AD_7$ will be described. As previously described with respect to the objects of this invention better results are obtained by measuring the asparagus stem diameter at the position the predetermined dimension LA from the cut end of the stem toward the spike as shown in FIG. 6. For this purpose, the position which is apart by the predetermined dimension from the cut end of the asparagus stem toward the spike is measured by a length inspecting circuit, which will be described later in detail. In the length inspecting circuit, the presence or absence of asparagus is detected every horizontal scanning period, and in the case of the presence of asparagus the number of horizontal drive signals is counted to measure the length.

One input terminal LA of the AND circuit $AD_7$ is connected to the output terminal of the length inspecting circuit, and the logical level "1" is applied through the terminal VMSK to the other input terminal of the AND circuit $AD_7$ during the period of processing one field of the asparagus viewed by the television camera. The vertical mask signal applied to the input terminal VMSK is to prevent the influence of the residual image of the television camera. Thus, the AND circuit $AD_7$ is enabled upon receiving a signal indicated by reference character LA in FIG. 11 from the length inspecting circuit during the one-field processing period, to apply the logic "1" to one input terminals of the AND circuits $AD_3$ through $AD_6$.

Figure 12:
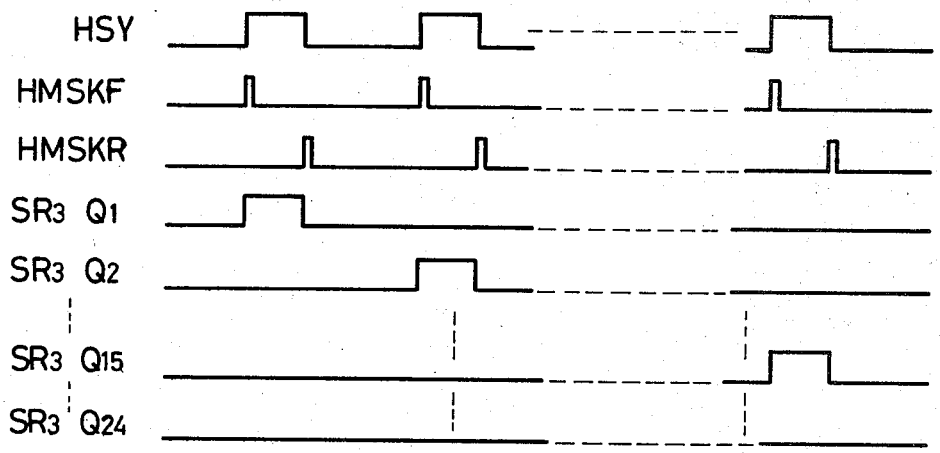

The K input terminals of the $FF_1$ through $FF_4$ are grounded to have the logic "0". The clock pulse input terminals CK of the flip-flops $FF_1$ through $FF_4$ are connected to the output terminal of an AND circuit $AD_8$ to one of the input terminals of which the 6 MHz clock pulse $CK_1$ is applied. The other input terminal of the AND circuit $AD_8$ is connected to the terminal VMSK. The Q output terminal of the $FF_1$ is connected to the clear input terminal CL of the $FF_2$. The $\overline{Q}$ output terminal of the $FF_1$ is connected one input terminal of an AND circuit $AD_9$. The clear input terminal CL thereof is connected to a terminal PH1R to which a fall signal PH1R corresponding to the fall of the substance arrival signal PH1 as shown in FIG. 12 is applied.

The Q output terminal of the $FF_2$ is connected to the other input terminal of the AND circuit $AD_9$ and the clear input terminal CL of the $FF_3$, and the $\overline{Q}$ output terminal is connected one input terminal of an AND circuit $AD_{10}$. The Q output terminal of the $FF_3$ is connected to the other input terminal of the AND circuit $AD_{10}$ and the clear input terminal CL of the $FF_4$ and the $\overline{Q}$ output terminal is connected to one input terminal of an AND circuit $AD_{11}$. The Q output terminal of the $FF_4$ is connected to the other input terminal of the AND circuit $AD_{11}$, and the $\overline{Q}$ output terminal is connected to one input terminal of an AND circuit $AD_{15}$. The output terminal of the AND circuit $AD_9$ is connected to one input terminal of an AND circuit $AD_{12}$, the output terminal of the AND circuit $AD_{10}$ is connected to one input terminal of an AND circuit $AD_{13}$, and the output terminal of the AND circuit $AD_{11}$ is connected to one input terminal of the AND circuit $AD_{14}$. The other input terminals of the AND circuits $AD_{12}$ through $AD_{15}$ are connected to the output terminal of an AND circuit $AD_{16}$.

An asparagus length acceptability signal $L\overline{O}K$ and a ratio acceptability signal $K\overline{O}K$ with respect to the ratio of the stem diameter to the spike maximum diameter are applied to the two input terminals of the AND circuit $AD_{16}$, respectively. The calculation of the length acceptability signal $L\overline{O}K$ and the ratio acceptability signal $K\overline{O}K$ will be described later. The AND circuit $AD_{16}$ operates to permit pieces of asparagus to be sorted out according to the stem diameter only when the asparagus is acceptable in length and the ratio of the stem diameter to the spike maximum diameter is within the predetermined range. That is, the AND circuit $AD_{16}$ prohibits the size classification in the case where the asparagus is too short or too long and the spike is open.

In the decision circuit 105, the flip-flops $FF_1$ through $FF_4$ store the coincidence outputs of the coincidence circuits 101 through 104 obtained when the AND circuit $AD_7$ is in conductive state. If the AND circuit $AD_7$ is rendered conductive for the period as indicated by reference character LA in FIG. 11 and the AND circuits $AD_3$ through $AD_5$ are rendered conductive momentarily as indicated by $AD_3$ through $AD_5$ in FIG. 11, then the flip-flops $FF_1$ through $FF_3$ are set. Hence, the fact that the stem diameter of the asparagus is smaller than the medium size is stored. The AND circuits $AD_9$ and $AD_{10}$ are momentarily rendered conductive as indicated by $AD_9$ and $AD_{10}$ in FIG. 11, and only the AND circuit $AD_{11}$ is maintained conductive. Therefore, the asparagus is indicated as a medium size by the output signal of the AND circuit $AD_{11}$. The output signal of the AND circuit $AD_{11}$ is applied to the memory circuit 106 with the aid of the length acceptability signal $L\overline{O}K$ and the ratio acceptability signal $K\overline{O}K$ from the AND circuit $AD_{16}$.

The memory circuit 106 is made up of four shift registers $SR_1$ through $SR_4$, change-over switches $SW_1$ through $SW_4$, and relay drive circuits 107. Each of the shift resistors $SR_1$ through $SR_4$ is a non-circulation type shift register. The shift registors $SR_1$ through $SR_4$ receive the outputs of the AND circuits $AD_{12}$ through $AD_{15}$, respectively, and employs, as a shift pulse, a signal PH1F at the rise of the substance arrival signal. The substance arrival signal PH1 which is the detection signal of the photoelectric switch 16 in FIG. 1 is indicated by reference character PH1 in FIG. 13. Signals at the rise and fall of the substance arrival signal are formed as the rise signal PH1F and a fall signal PH1R, respectively.

Accordingly, shift registers $SR_1$ through $SR_4$ are shifted by the rise signal PH1F of the substance arrival signal and therefore the decision output is stored in the shift registers $SR_1$ through $SR_4$ before the decision output of the decision circuit 105 is eliminated by the fall signal PH1R of the substance arrival signal. Stated differently, shift registers $SR_1$ through $SR_4$ are shifted by the rise signal PH1F of the substance arrival signal indicated by reference character PH1F in FIG. 13. Thereafter the $FF_1$ as well as the $FF_2$ through $FF_4$ in the decision circuit 105 are reset by the fall signal PH1R of the substance arrival signal indicated by reference character PH1R in FIG. 13.

The bit outputs of the shift registers $SR_1$ through $SR_4$ are applied to the input terminals of the change-over switches $SW_1$ through $SW_4$, respectively. For instance where it is required to provide the n-th bit output of the shift register $SR_1$, the change-over switch $SW_1$ is switched to the corresponding n-th contact so that the change-over switch $SW_1$ extracts the n-th bit output of the shift register $SR_1$ at all times. The change-over positions of the change-over switches $SW_1$ through $SW_4$ correspond to the position of the rotary solenoids 3 through 6 in FIG. 1, respectively.

For instance, if it is assumed that four containers 27 are provided between the rotary solenoid 3 and the industrial television camera 14, and that five containers 27 are present between the rotary solenoids 3 and 4, five containers 27 are present between the rotary solenoids 4 and 5, and five containers 27 are present between the rotary solenoids 5 and 6. In this case, the change-over switch $SW_1$ is switched to extract the fifth bit of the shift register $SR_1$ and the change-over switch $SW_2$ is switched to extract the tenth bit of the shift register $SR_2$. The change-over switch $SW_3$ is switched to extract the fifteenth bit of the shift register $SR_3$, and the change-over switch $SW_4$ is switched to extract the twentith bit of the shift register $SR_4$. The relay drive circuits 107 connected to the respective change-over switches $SW_1$ through $SW_4$ operate and control the energization and deenergization of the respective rotary solenoids 3 through 6.

Figure 11:
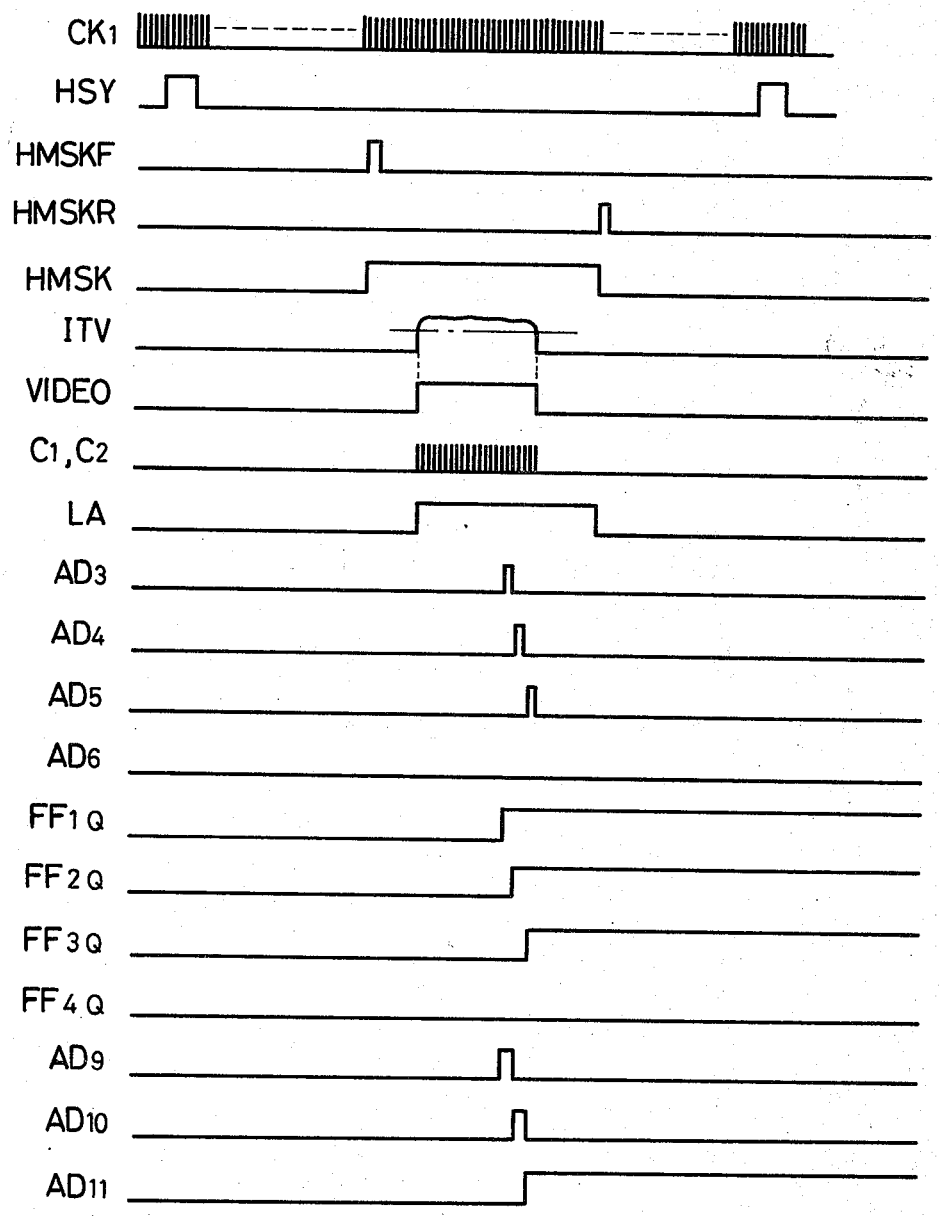
FIGS. 11 through 15 are waveform diagrams for a description of the operations of the various circuits shown in FIGS. 7 through 10.

In the memory circuit 106, the decision output of the decision circuit 105 described herein is stored by the shift registers $SR_1$ through $SR_4$. More specifically, when the decision output as indicated by reference character $AD_{11}$ in FIG. 11 is outputted by the AND circuit $AD_{11}$ in the decision circuit 15, the decision output is stored at the first bit in the shift register $SR_3$ with the aid of the rise signal PH1F of the substance arrival signal as indicated by reference character SR3Q1 in FIG. 12.

Then, the shift register is shifted by the rise signal PH1F of the substance arrival signal which is successively produced and simultaneously when the fifteenth substance arrival signal PH1 is produced, the logical signal "1" is applied from the fifteenth bit of the shift register $SR_3$ through the change-over switch $SW_3$ to the relay drive circuit 107 as indicated by reference character SR3–Q15 in FIG. 12. As a result, the rotary solenoid 5 in FIG. 1 is energized to remove the asparagus in the container 27 into the sorting box 12.

Figure 8:
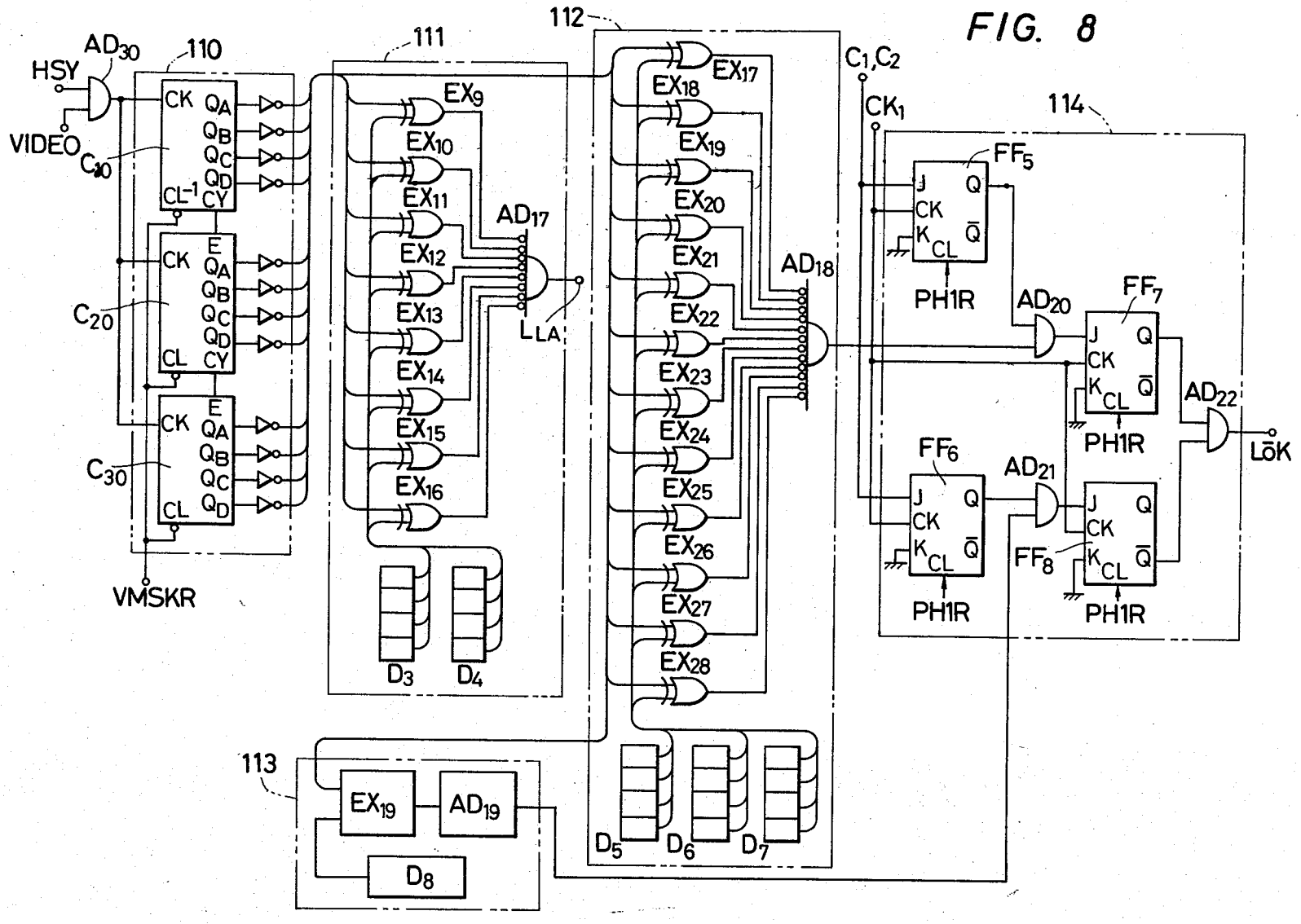

The length calculation circuit will next be described with reference to FIG. 8. Length calculation circuit comprises: a counting circuit 110 for counting the horizontal drive signal of the industrial television camera 14 according to the video signal of the television camera and a coincidence circuit 111 for detecting the coincidence between the count value of the counting circiut 110 and a set value defining a predetermined dimension LA from the cut end of a piece of asparagus toward the spike thereof. A second coincidence circuit detects the coincidence between the count value of the counting circuit 110 and a set lower limit value used to determine whether or not an asparagus length is within an allowable range. A third coincidence circuit 113 detects the coincidence between the count value of the counting circuit 110 and a set upper limit value used to determine the upper limit in length of the asparagus.

A decision circuit 114 carries out the length decision according to the outputs of the coincidence circuits 112 and 113 defining the lower limit value and the upper limit value of asparagus respectively. The decision circuit 114 provides a length acceptability signal LOK only when the coincidence circuit 112 provides the coincidence output and the coincidence circuit 113 provides no coincidence output.

The counting circuit 110 has four-bit counters $C_{10}$, $C_{20}$ and $C_{30}$, which form three decimal digits. The output terminal of an AND circuit $AD_{30}$ is connected to the clock pulse input terminals of the counters $C_{10}$, $C_{20}$ and $C_{30}$. A horizontal drive signal HSY is applied to one input terminal of the AND circuit $AD_{30}$. During one field processing field a logical signal VIDEO is applied to the other input terminal of the AND circuit $AD_{30}$. The logical signal VIDEO is obtained by binary-coding the image signal of the television camera as indicated by reference character ITV in FIG. 13.

Accordingly, the AND circuit $AD_{30}$ generates the horizontal drive signal which is provided when the binary-coded logical signal VIDEO is at the logic "1". A signal obtained by inverting the vertical mask signal VMSK synchronous with the vertical drive signal VSY is applied to the clear terminals of the counters $C_{10}$, $C_{20}$ and $C_{30}$. Therefore, the counters $C_{10}$, $C_{20}$ and $C_{30}$ are reset every one-field processing period.

The output of the counting circuit 110 is applied to one input terminal of EXCLUSIVE OR circuits $Ex_9$ through $Ex_{29}$ connected to the coincidence circuits 111, 112 and 113. Setting devices $D_3$ and $D_4$ are connected to the other input terminals of the EXCLUSIVE OR circuits $Ex_9$ through $Ex_{16}$ of the coincidence circuit 111. Each of the setting devices $D_3$ and $D_4$ has the weights of four bits, thus forming two decimal digits. An AND circuit $AD_{17}$ receives signals obtained by inverting the outputs of the EXCLUSIVE OR circuits $Ex_9$ through $Ex_{16}$.

When data set by the setting devices coincides with the count value of the counting circuit 110, all of the outputs of the EXCLUSIVE OR circuits $Ex_9$ through $Ex_{16}$ are changed to the logic "0". Accordingly, the AND circuit $AD_{17}$ is rendered conductive as indicated by reference character $AD_{17}$ in FIG. 13. This coincidence output of the coincidence circuit 111 is provided only during one horizontal scanning period, representing the position which is separated from the cut end of the asparagus stem by the dimension LA toward the spike thereof. It is applied to one input terminal of the AND circuit $AD_7$ in the above-described decision circuit of FIG. 7 adapted to calculate the stem diameter.

The coincidence circuit 112 has setting devices $D_5$, $D_6$ and $D_7$ each having the weights of four bits, to provide three decimal digits. The setting devices $D_5$ through $D_7$ are connected to the respective EXCLUSIVE OR circuits $Ex_{17}$ through $Ex_{28}$. The setting devices $D_5$ through $D_7$ are adapted to set the lower limit in length, one of the factors for determining whether or not the asparagus length is in the acceptable range. The coincidence circuit 112 also has an AND circuit $AD_{18}$ which receives signals obtained by inverting the outputs of the EXCLUSIVE OR circuits $Ex_{17}$ through $Ex_{28}$. The AND circuit $AD_{18}$ is rendered conductive when all of the outputs of the EXCLUSIVE OR circuits $Ex_{17}$ through $Ex_{28}$ are lowered to the logic "0", i.e., data set by the setting devices $D_5$ through $D_7$ coincides with the count value of the counting circuit 110, thus applying the coincidence output to the decision circuit 114.

The coincidence circuit 113 indicated by the one-dot chain line is similar in arrangement to the coincidence circuit 112, and has twelve EXCLUSIVE OR circuit 19. AND circuit $AD_{19}$ receives signals obtianed by inverting the outputs of the EXCLUSIVE OR circuits 19, and a setting means $D_8$. The setting means $D_8$ comprises three 4-bit setting devices. The setting means $D_8$ is adapted to set the upper limit value which is used to determine whether or not the asparagus length is in the allowable range. Thus, the coincidence circuit 111 provides the coincidence output for the position which is separated by the dimension LA from the cut end of the asparagus toward the spike. The coincidence circuits 112 and 113 provide the coincidence outputs depending on whether or not the asparagus length is within the allowable range. Accordingly, when the coincidence circuit 112 provides the coincidence output but the coincidence circuit 113 provides no coincidence output, it is confirmed that the asparagus length is within the allowable range.

The decision circuit 114 comprises four J-K flip-flops $FF_5$ through $FF_8$ and three AND circuits $AD_{20}$ through $AD_{22}$. The count output of the asparagus stem diameter is applied to the J input terminals of the flip-flops $FF_5$ and $FF_6$. That is, one bit output Cn of the four bit outputs of the counting circuit 100 is applied to the J input terminals. The 6 MHz clock pulse $CK_1$ is applied to the clock pulse input terminals CK of the flip-flops, and the fall signal PH1R of the substance arrival signal is applied to the clear terminals CL. The Q outputs of the flip-flops $FF_5$ and $FF_6$ are applied to one input terminals of the AND circuits $AD_{20}$ and $AD_{21}$. The other input terminals are connected to the output terminals of the AND circuits $AD_{18}$ and $AD_{19}$ in the coincidence circuits 112 and 113, respectively.

The J input terminals of the flip-flops $FF_7$ and $FF_8$ are connected to the output terminals of the AND circuits $AD_{20}$ and $AD_{21}$, respectively. The 6 MHz clock pulse is applied to the clock pulse input terminals CK of the flip-flops $FF_7$ and $FF_8$, and the fall signal PH1R of the substance arrival signal is applied to the clear terminals CL thereof. The Q output terminal of the flip-flop $FF_7$ and the $\overline{Q}$ output terminal of the flip-flop $FF_8$ are connected to two input terminals of the AND circuit 22, respectively. The output of AND circuit 22 is applied, as the length acceptability signal $L\overline{O}K$, to the decision circuit 105 in the stem diameter calculation circuit (FIG. 7).

In the decision circuit 114, the flip-flops $FF_5$ and $FF_6$ are set by the output of the counting circuit 100 adapted to count the stem diameter, whereby the presence of a piece of asparagus is stored. Under the condition where the flip-flop $FF_5$, the AND circuit $AD_{20}$ applies the coincidence output of the coincidence circuit 112 to the flip-flop $FF_7$, $FF_7$ is set as indicated by reference character $FF_7Q$ in FIG. 13. Simultaneously when the flip-flop $FF_7$ is set, the AND circuit $AD_{22}$ is rendered conductive as indicated by reference character $AD_{22}$ in FIG. 13.

Thereafter, if the AND condition of the AND circuit $AD_{21}$ is not established, the AND circuit $AD_{22}$ is maintained conductive to continuously apply the length acceptability signal $L\overline{O}K$. When the flip-flops $FF_7$ and $FF_8$ are reset by the fall signal PH1R of the substance arrival signal, the AND circuit $AD_{22}$ is rendered non-conductive. The conduction of the AND circuit $AD_{21}$ after the flip-flop $FF_7$ has been set by the AND circuit $AD_{20}$ and means that the coincidence output has been provided by the coincidence circuit 113. In this case, the flip-flop $FF_8$ is set and as a result the AND circuit $AD_{22}$ is rendered non-conductive. Hence, no length acceptability signal $L\overline{O}K$ is produced.

Now, the circuit for calculating the ratio of the asparagus spike maximum diameter to the stem diameter will be described. In order to calculate the ratio, first it is necessary to calculate the spike maximum diameter. Therefore, a maximum diameter holding circuit will be described with reference to FIG. 9.

The maximum diameter holding circuit comprises: a J-K flip-flop $FF_9$, a comparison circuit 120 for carrying out comparison with binary signals, a holding circuit 121 for holding the maximum diameter, and an AND circuit $AD_{23}$. The count output of the counting circuit 100 adapted to count the stem diameter is applied through a terminal $C_{12}$ to comparison input terminals $A_0$, $A_1$, $A_2$ and $A_3$ of the comparison circuit 120, and to the input terminals of the 8-bit holding circuit 121.

The outputs $Q_A$, $Q_B$, $Q_C$ and $Q_D$ of the holding circuit are applied, as a reference signal, to the terminals $B_0$, $B_1$, $B_2$ and $B_3$ of the comparison circuit 120. They are also delivered through a maximum diameter output terminal LR. The J input terminal of the flip-flop $FF_9$ is connected to the count output terminals $C_{10}$, $C_{20}$ and $C_{30}$ of the counting circuit 110 in the length calculation circuit. When the count value of the counting circuit 110 reaches a predetermined value, the logic "1" signal is applied to the J input terminal. This is to prevent the situation where the stem diameter is regarded as the spike maximum diameter.

The 6MHz clock pulse is applied to the clock pulse input terminal CK of the flip-flop $FF_9$. The AND circuit $AD_{23}$ receives the Q output of the flip-flop $FF_9$, the horizontal mask signal HMSK, and the output of the comparison circuit 120. The output terminal of the AND circuit $AD_{23}$ is connected to the clock pulse input terminal CK of the holding circuit 121. The signal PH1R which is provided at the fall of the substance arrival signal is applied to the clear terminals CL of the holding circuit 121 and the flip-flop $FF_9$.

The comparison input $A_0$, $A_1$ $A_2$ $A_3$ of the comparison circuit 120 is the count output of the counting circuit 100 adapted to count the stem diameter. This count output is cleared by the horizontal mask start signal HMSKR every horizontal scanning period. If the comparison input $A_0$, $A_1$, $A_2$, $A_3$, the count output of the counting circuit 100 is represented by A, and the reference input $B_0$, $B_1$, $B_2$, $B_3$, the output of the holding circuit 121 is represented by B, then the logic "1" signal is applied to the input terminal of the AND circuit $AD_{23}$ when $A > B$.

Figure 9:
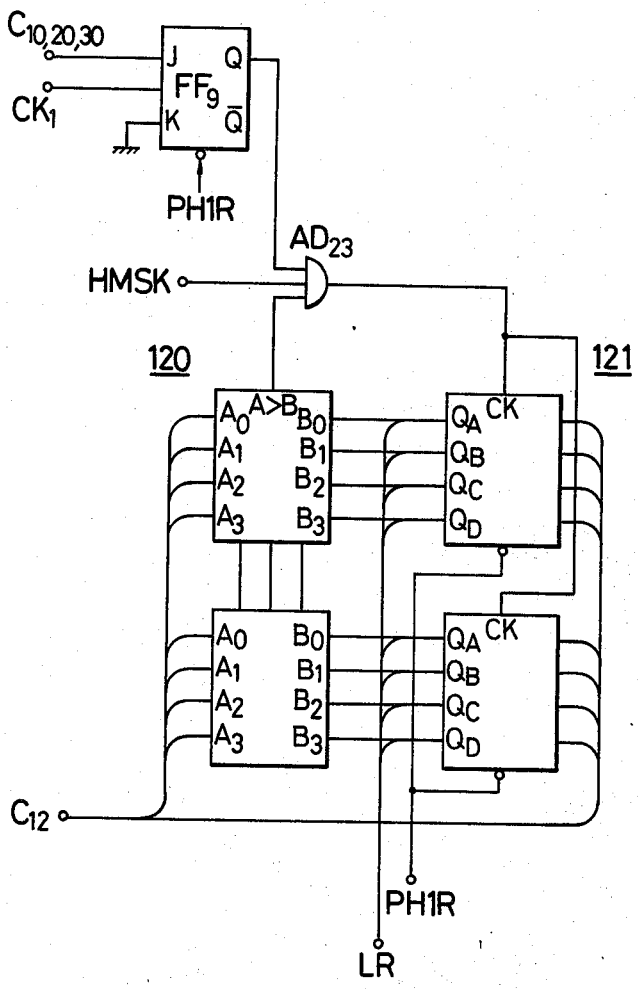
Figure 14:
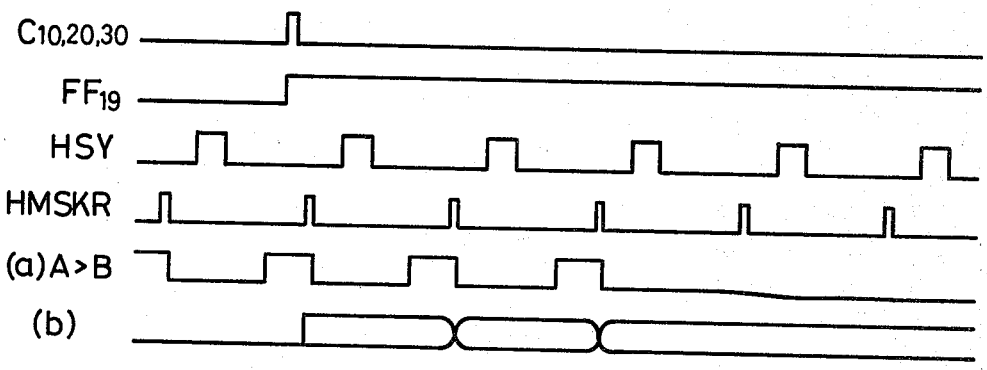

The operation of the maximum diameter holding circuit of FIG. 9, thus organized is initiated after the flip-flop $FF_9$ is set. The flip-flop $FF_9$ is set when the count value of the counting circuit 110 adapted to count the asparagus length reaches a predetermined value, for instance, "100", which indicates the asparagus length measured for the cut end of the stem. When an output pulse as indicated by reference character $C_{10, 20, 30}$ in FIG. 14 is provided by the above-described counting circuit 110, the flip-flop $FF_9$ is set as indicated by reference character $FF_{19}$ in FIG. 14.

The reference input B of the comparison circuit 120 is maintained at zero until the count value of the counting circuit 100 is inputted into the holding circuit 121. AN output waveform applied to the AND circuit $AD_{23}$ of the comparison circuit 120 is indicated by reference symbol (a) in FIG. 14. When the flip-flop $FF_9$ is set, the logic "1" signal is outputted by the comparison circuit 120, and the horizontal mask start signal HMSKR as indicated by reference character HMSKR in FIG. 14 is applied to the AND circuit $AD_{23}$. Then the AND circuit $AD_{23}$ is rendered conductive. The output pulse of the AND circuit $AD_{23}$ is applied, as an input signal to the holding circuit 121. The count value of the diameter counting circuit 100 is inputted into the holding circuit 121 and is stored therein. This state of the holding circuit 121 is as indicated by reference symbol (b) in FIG. 14.

After the count value of the counting circuit 100 has been stored in the holding circuit 121, the count data of the counting circuit 100 is cleared, the next horizontal scanning is started, and the spike diameter is counted by the counting circuit 100. This count value of the counting circuit is applied to the comparison input terminals $A_0$, $A_1$, $A_2$ and $A_3$ of the comparison circuit 120 and is compared with the data stored in the holding circuit 121. If the count value of the counting circuit 100 is greater than the data stored in the holding circuit 121, the comparison input A, the reference input B in the comparison circuit 120, and therefore the comparison circuit 120 applies the logic "1" signal to the AND circuit $AD_{23}$. As a result, the AND circuit $AD_{23}$ applies the clock pulse to the holding circuit 121 as in the above-described case in response to the application of the horizontal mask start signal HMASR. Hence the data stored in the holding circuit 121 is renewed.

In the case where the count value of the counting circuit 100 is smaller than the data stored in the holding circuit 121, the logic "1" signal is not applied to the AND circuit $AD_{23}$ by the comparison circuit 120. Therefore, the data stored in the holding circuit 121 is not renewed.

Whenever the spike diameter is counted by the counting circuit 100, the count data is compared to the data stored in the holding circuit 121 in the comparison circuit 120, so that the data stored in the holding circuit 121 is rewritten into the count data representative of a larger spike diameter. As a result the maximum diameter of the spike is stored in the holding circuit 121. The data representative of the spike maximum diameter thus stored is delivered through the terminal LR.

Figure 10:
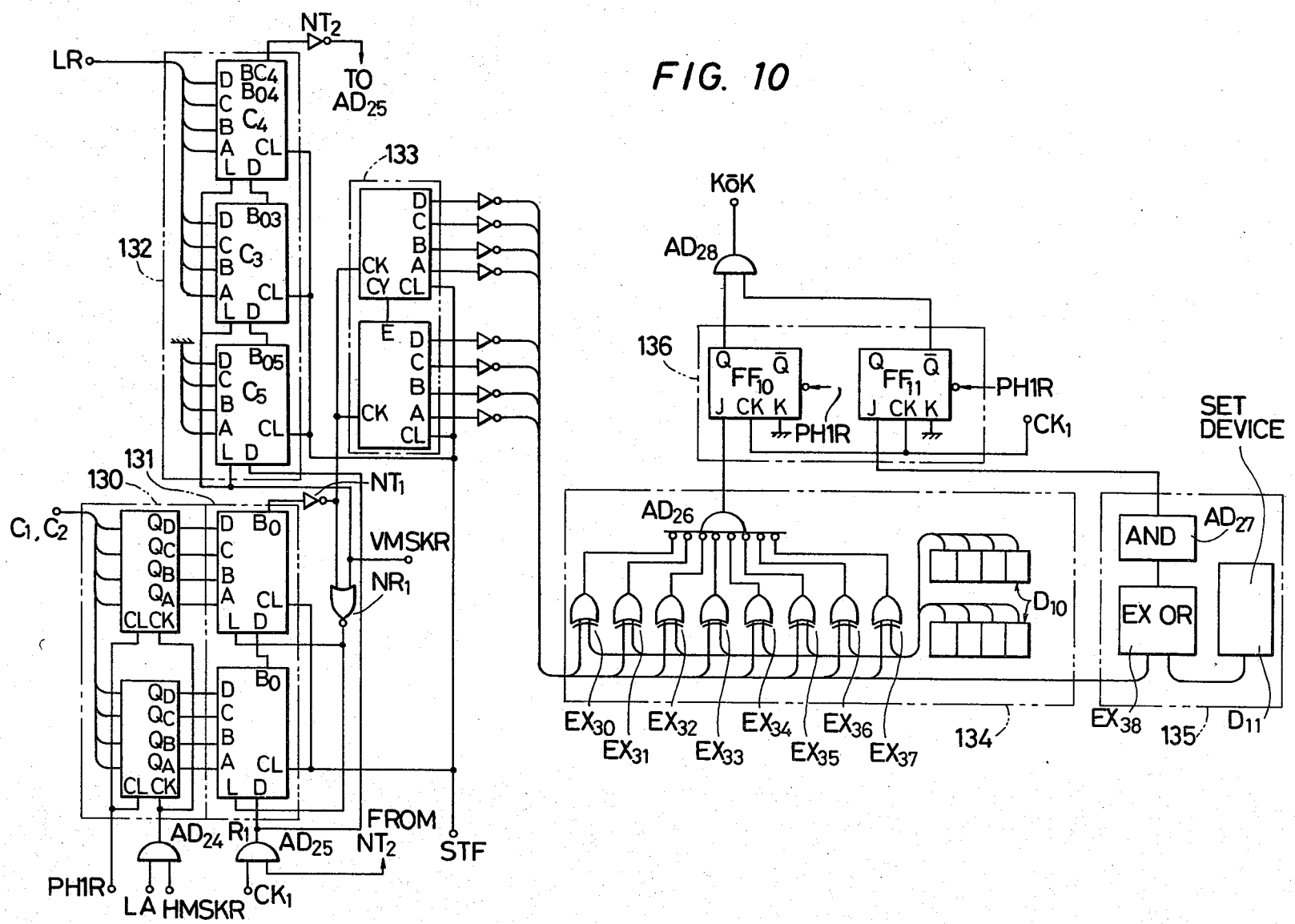

A ratio calculation circuit for calculating the ratio of the spike maximum diameter to the spike diameter will be described with reference to FIG. 10. The calculation circuit comprises: a holding circuit for storing and holding the count value of a stem diameter and subtraction counters 131 and 132. A counter 133 provides the quotient of the subtraction counter 131 and a coincidence circuit 134 sets the lower limit value which is used to determine whether or not the ratio of the spike maximum diameter to the stem diameter is within an allowable range, and detects the coincidence between the set value and the ratio. A second coincidence circuit 135 detects the coincidence between the set value that is the upper limit value of the allowable range and the aforementioned ratio and a ratio decision circuit 136.

The holding circuit 130 has a storage capacity of eight bits, and is connected to the output terminal of the counting circuit 100 adapted to count the stem diameter. The clock pulse input terminal CK of the holding circuit 130 is connected to the output terminal of an AND circuit $AD_{24}$ which receives the output LA of the coincidence circuit 111 in the asparagus length calculating circuit and the horizontal mask signal HMSKR, so that the stem diameter at the position separated by the dimension LA from the cut end of the asparagus stem toward the spike is stored in the holding circuit 130.

The output of the holding circuit 130 is connected to the input terminals of the subtraction counter 131. The subtraction pulse input terminal D of counter 131 is coupled to the output terminal of an AND circuit $AD_{25}$. The 6MHz clock pulse $CK_1$ and the inversion signal of the quotient of the subtraction counter 132 which is applied through an inversion circuit $NT_2$ from the quotient output Bo of the subtraction counter 132 are applied to the two input terminals of the AND circuit $AD_{25}$. The output terminal of a gate $NR_1$ is connected to the input terminal L of the subtraction counter 131. Applied to the input terminals of the gate $NR_1$ are the quotient output Bo of the subtraction counter 131 and the vertical mask start signal VMSKR.

Thus, the clock pulse is applied through the gate $NR_1$ to the input terminal L of the subtraction counter 131 depending on the application of the vertical mask start signal VMSKR or the quotient output of the subtraction counter 131 after the one-field processing period. Hence, the count value of the stem diameter stored in the holding circuit 130 is inputted thereinto.

The subtraction counter 132 is made up of counters $C_3$ and $C_4$ which form two decimal digits for inputting the maximum diameter stored in the holding circuit 121 in the maximum diameter calculation circuit, and a decimal 1-digit counter $C_5$ for multiplying the contents of the counters $C_3$ and $C_4$ forming the two decimal digits by ten. Accordingly, the spike maximum diameter is represented by three decimal digits. This is utilized to perform the calculation of the ratio of the spike maximum diameter to the stem diameter to the tenths. The vertical mask start signal VMSKR is applied to the input terminals L of the subtraction counter 132. The maximum diameter is inputted into the counters $C_3$ and $C_4$ of the subtraction counter 132 when the vertical mask start signal VMSKR is applied thereto after one-field processing period. In this operation, each of the four bits in the counter $C_5$ is lowered to the logic lever "0".

The subtraction pulse input terminal D of the counter $C_5$ for the first decimal digit in the subtraction counter 132 is connected to the output terminal of the AND circuit $AD_{25}$. The quotient output terminal $Bo_5$ of the counter $C_5$ is connected to the subtraction pulse input terminal D of the counter $C_3$ for the second decimal digit. The quotient output terminal $Bo_3$ of the counter $C_3$ is connected to the subtraction pulse input terminal D of the counter $C_4$ for the third decimal digit. The quotient output terminal $Bo_4$ of the counter $C_3$ is connected through the inversion circuit $NT_2$ to the input terminal of the AND circuit $AD_{25}$.

The clock pulse input terminals CK of the counting circuit 133 is connected to the quotient output terminal Bo of the subtraction counter 131 so that the result of calculation of the ratio of the spike maximum diameter to the stem diameter is counted by the decimal 2-digit counting circuit 133.

The digit outputs of the counting circuit 133 are applied to respective EXCLUSIVE OR circuit $Ex_{30}$ through $Ex_{37}$ in the coincidence circuit 134. The other input terminals of the EXCLUSIVE OR circuit $Ex_{30}$ through $Ex_{37}$ are connected to the digits of a setting device $D_{10}$. The setting device $D_{10}$ is to set the lower limit value which is used to determine whether or not the quotient of the ratio, i.e., the count value of the counting circuit 133 is in an allowable range. An AND circuit $AD_{26}$ receives signals obtained by inverting the outputs of the EXCLUSIVE OR circuit $Ex_{30}$ through $Ex_{37}$, and is rendered conductive when the outputs of the EXCLUSIVE OR circuits $Ex_{30}$ through $Ex_{37}$ are set to the logic level "0".

The coincidence circuit 135 illustrated as a block diagram is similar in arrangement to the above-described coincidence circuit 134. The coincidence circuit 135 comprises a setting device $D_{11}$, an EXCLUSIVE OR means $Ex_{38}$ to which the digits of the counting circuit 133 and the digits of the setting device $D_{11}$ are connected, and an AND circuit $AD_{27}$ receiving signals obtained by inverting the outputs of the EXCLUSIVE OR means $Ex_{38}$. The setting device $D_{11}$ is to set the upper limit value which is used to determine whether or not the count value of the counting circuit 133 is in an allowable range.

The decision circuit 136 has flip-flops $FF_{10}$ and $FF_{11}$ which receive the coincidence outputs of the AND circuits $AD_{26}$ and $AD_{27}$ in the coincidence circuits 134 and 135, respectively. The decision circuit 136 delivers the decision result through an AND circuit $AD_{28}$. The 6MHz clock pulse $CK_1$ is applied to the clock pulse input terminals CK of the flip-flops $FF_{10}$ and $FF_{11}$, and the fall signal PH1R of the substance arrival signal is applied to the clear terminals. The Q output terminal of the flip-flop $FF_{10}$ and the $\overline{Q}$ output terminal of the flip-flop $FF_{11}$ are connected to the two input terminals of the AND circuit $AD_{28}$, respectively. When the $\overline{Q}$ output of the flip-flop $FF_{11}$ and the Q output of the flip-flop $FF_{10}$ are raised to the logic level "1", the AND circuit $AD_{28}$ is rendered conductive to deliver the acceptability signal $K\overline{O}K$.

The operation of the ratio calculation circuit thus organized will be described. The clear terminals CL of the subtraction counters 131 and 132 and the counting circuit 133 are applied with a clear signal such that the clear input is applied in response to the rise signal PH1F of the substance arrival signal and is eliminated in response to the vertical mask start signal VMSKR after one-field processing period. Accordingly, in the subtraction counters 131 and 132 and the counting circuit 133, the subtraction and the count are not performed until the completion of the spike maximum diameter calculation because the clear input is applied thereto. The count data of the counting circuit 100 adapted to count the stem diameter is applied to the input terminals of the holding circuit 130.

In the holding circuit 130, the stem diameter is stored when the clock pulse is applied to the clock pulse input terminals CL of the holding circuit 130 in response to the AND gate output of the coincidence output LA from the coincidence circuit 111 adapted to calculate the asparagus length and the horizontal mask start signal HMSKR. Since the output of the spike maximum diameter holding circuit 121 is connected to the counters $C_3$ and $C_4$ in the substraction counter 132, the spike maximum diameter is applied to the counter $C_3$ and $C_4$. However, the maximum diameter is not inputted into the subtraction counter 132 before the pulse is applied to the inputting terminals L thereof.

Figure 15:
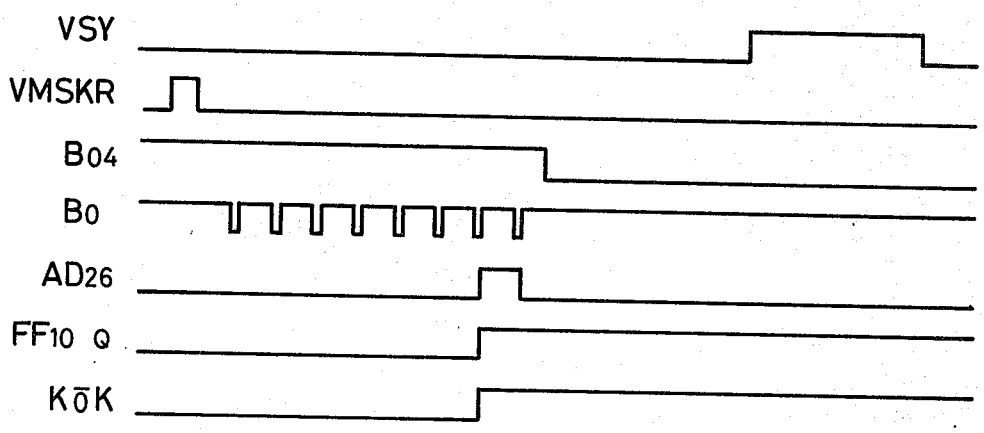

The vertical mask start signal VMSKR as indicated by reference character VMSKR in FIG. 15, produced at the completion of the one-field processing period, and the clear signal applied to the clear terminals CL of the subtraction counters 131 and 132 and the counting circuit 133 are simultaneously eliminated. The vertical mask start signal VMSKR is applied through the gate $NR_1$ to the inputting terminals of L of the subtraction counters 131 and 132.

As a result, the stem diameter is inputted into the holding circuit 130 from the subtraction counter 131, while the spike maximum diameter is inputted into the subtraction counter 132. Since the quotient output of the counter $C_4$ in the subtraction counter 132 is at the logic level "0" as indicated by reference character Bo in FIG. 15, the subtraction counters 131 and 132 carry out the subtractions whenever the 6MHz clock pulse is applied to the respective subtraction pulse input terminals D. If the subtraction result of the subtraction counter 131 is zero (0), that is, the logic "0" signal is delivered through the quotient output terminal Bo as indicated by reference character Bo in FIG. 15. Simultaneously when this logic "0" signal is applied through the gate $NT_1$ to the counting circuit 133 and is counted thereby, the logic "0" signal is applied through the NOR circuit $NR_1$ to the inputting terminals L of the subtraction counter 131. As a result, the stem diameter is read out of the holding circuit 130 into the subtraction counter 131 again where the subtraction is carried.

The above-described operation is repeatedly carried out in the subtraction counter 131, and its quotient output is counted by the counting circuit 133. Whenever the quotient output is delivered out of the subtraction counter 131, the value corresponding to the stem diameter is subjected to subtraction in the subtraction counter 132. While the subtractions are carried out by the subtraction counters 131 and 132, the coincidence comparison between the count value of the counting circuit 133 and the value set by the setting devices $D_{10}$ and $D_{11}$ is carried out in the coincidence circuits 134 and 135. When the quotient output at the logic level "0" as indicated by reference character $Bo_4$ in FIG. 15 is outputted from the quotient output terminal $BO_4$ of the counter $C_4$ in the above-described subtraction counter 132, the AND condition of the AND circuit $AD_{26}$ is not established. As a result, no clock pulse is applied to the subtraction counters 131 and 132.

In the coincidence circuit 134, when the count value of the counting circuit 133 coincides with the lower limit value set by the setting device $D_{10}$, all of the outputs of the EXCLUSIVE OR circuits $Ex_{30}$ through $Ex_{37}$ are set to the logic level "1". As a result, the AND circuit $AD_{26}$ is rendered conductive as indicated by reference character $AD_{26}$ in FIG. 15, thereby delivering the coincidence output to the flip-flop $FF_{10}$ in the decision circuit 136. Similarly as in the case of the coincidence circuit 136, the coincidence circuit 135 delivers the coincidence output to the flip-flop $FF_{11}$ in the decision circuit 136 through the EXCLUSIVE OR means $Ex_{38}$ and the AND circuit $AD_{27}$ when the count value of the counting circuit 133 coincides with the upper limit value set by the setting device $D_{11}$.

When the flip-flop $FF_{10}$ receives the coincidence output from the coincidence circuit 134, the decision circuit 136 is set as indicated by reference character $FF_{10}Q$ in FIG. 15. When the flip-flop $FF_{11}$ is not set because no coincidence output is applied thereto from the coincidence circuit 135, the decision circuit 136 outputs the acceptability signal $K\bar{O}K$ as indicated by reference character $K\bar{O}K$ in FIG. 15. In the case where the flip-flop $FF_{11}$ is set by the coincidence signal from the coincidence circuit 135, the AND circuit $AD_{28}$ becomes nonconductive. Therefore no acceptability signal $K\bar{O}K$ is delivered. Thereafter, upon arrival of the following substance, the data stored in the holding circuit 130 and the flip-flops $FF_{10}$ and $FF_{11}$ are cleared by the fall signal PHIR of the substance arrival signal.

As is apparent from the above description, this invention offers improved performance in that elongated pieces such as asparagus and the like are positively stored out into acceptable and unacceptable items, and the pieces determined to be acceptable are further subject to quick selection according to the size. This is accomplished without rendering subjective judgements of human inspectors. It is also apparent that modifications of this invention are possible without departing from the essential scope thereof.

What is claimed is:

1. A method for sorting elongated pieces having a stem and a spike portion at one end comprising the steps of:

successively conveying said elongated pieces on conveyer means to a detection station;

detecting the outline of each of said elongated pieces as a still image by a sensor;

generating and processing signals from said still image to measure and determine, the length of said elongated member, the diameter of the stem of said elongated member and a ratio of the spike maximum diameter to the stem diameter; and selectively comparing the determined parameters with predetermined reference values, and sorting said elongated pieces according to size.

2. The method of claim 1 wherein the step of measurement of stem diameter occurs at a position on the shaft a predetermined distance from the end stem toward the spike.

3. The method of claims 1 or 2 wherein said elongated pieces are further sorted to reject pieces where the ratio of spike maximum diameter to stem diameter exceeds a predetermined value.

4. The method of claim 3 wherein said elongated pieces are asparagus.

5. The method of claim 3 wherein said elongated pieces are vegetables selected from the group consisting of asparagus, mushrooms, carrots and celery.

6. The method of claim 3 wherein the step of successively conveying comprises the steps of individually conveying elongated pieces on a conveyor having a plurality of compartments each adapted to hold and align a single elongated piece in a predetermined orientation.

7. The method of claim 6 further comprising the steps of sensing the position of a compartment to determine when it is within the view angle of said sensor and, momentarily lighting said elongated pieces for providing a still picture image.

8. The method of claim 6 wherein the further comprising the steps of conveying said elongated pieces in said plurality of compartments to a sorting section and selectively opening each of said compartments to discharge said elongated pieces into respective sorting containers in accordance with the determinations made of size.

9. The method of claim 8 wherein the step of said generating and processing signals occurs in the time interval following passage of an elongated piece in the view the sensor but prior to reaching said sorting section.

10. The method of claim 8 further comprising the steps discharging said elongated pieces from the bottom of said compartments and resetting the compartments to receive a new elongated piece for conveyence to said detection station.

11. A system for sorting elongated pieces having a stem and a spike portion at one end comprising:

conveyor means for receiving said elongated pieces from a source of supply and conveying them individually;

a sensor station having means for viewing said elongated pieces as they are individually conveyed past said sensor station;

means for converting said sensor output into electronic signals and using said signals to calculate relevant dimensions of said elongated pieces;

means for storing the calculated dimension parameters; and a sorting station for selectively discharging said elongated pieces from said conveyor means in accordance with calculated parameters; wherein said conveyor means comprises, an endless conveyor body, a plurality of containers arranged along the length of said conveyor body, each of said containers having a bottom plate, and means to open and close said bottom plates.

12. The system of claim 11 wherein said sorting station comprises a plurality of sorting bins, solenoid means associated with each sorting bin and actuated by said storage means, and cam means operated by respective solenoid means to selectively remove said elongated pieces from said conveyor means and deposit them in an appropriate bin.

13. The system of claim 11 wherein said means for converting includes circuit means for converting the output of said means for viewing into a binary coded format.

14. The system of claim 11 wherein said containers are configured to orient said elongated pieces in a direction transverse to the direction of movement.

15. The system of claim 14 wherein said containers further comprises a lever mounted on said bottom plate to respectively open and close said bottom plate, a spring for maintaining said bottom plate in either an open or closed state, and bumper means for contact at said sorting station.

16. The system of claim 15 wherein said sorting station comprises a plurality of sorting bins, solenoid means associated with each bin and actuated by said storage means, and cam means operated by respective solenoid means to selectively engage said bumper means on a container to discharge the contents of that container into an appropriate bin.

17. The system of claim 16 further comprising means to reset the bottom plates of said containers into a closed position following passage through said sorting station.

18. The system of claims 11 or 13 wherein said containers are coated with a light absorbing paint.

19. The system of claims 11 or 15 wherein said sensor station comprises illumination means for momentarily lighting said elongated pieces and said means for viewing comprises a television camera.

20. The system of claim 19 further comprising a position sensor to determine when said elongated pieces are in the field of view of said camera and actuating said illumination means.

21. The system of claim 19 wherein said position sensor comprises a photoelectric element positioned adjacent said illumination means.

22. A system for sorting elongated pieces having a stem and a spike portion at one end comprising:

conveyor means for receiving said elongated pieces from a source of supply and conveying them individually;

a sensor station having means for viewing said elongated pieces as they are individually conveyed past said sensor station;

means for converting said sensor output into electronic signals and using said signals to calculate relevant dimensions of said elongated pieces;

means for storing the calculated dimension parameters; and a sorting station for selectively discharging said elongated pieces from said conveyor means in accordance with calculated parameters; wherein said means for converting further comprises circuit means for calculating the length of said elongated pieces, and circuit means for determining the stem diameter of said elongated pieces.

23. The system of claim 22 wherein said means for converting further comprises circuit means to calculate spike maximum diameter and circuit means to calculate a ratio of spike maximum diameter to stem diameter.

24. The system of claim 23 wherein said circuit means to calculate a ratio of spike maximum diameter to stem diameter comprises a holding circuit for storing a count value from said circuit means to determine stem diameter, arithmatic means responsive to the holding circuit, coincidence circuit means receiving the output of said arithmatic means and logic circuit means to determine whether the ratio of stem diameter to maximum spike diameter is within a predetermined range.

25. The system of claim 24 wherein said coincidence circuit means comprises a first coincidence circuit determining coincidence of the output of said arithmatic means and a predetermined upper limit, a second coincidence circuit determining coincidence of the output of said arithmatic means and a predetermined lower limit and AND gate outputs for said first and second coincidence circuits.

26. The system of claim 24 wherein said holding circuit stores a signal indicative of stem diameter at a position a predetermined position from the cut end of the stem of said elongated pieces, and said arithmatic means comprises a subtraction counter receiving data indicative of maximum spike diameter and a counter for forming a quotient of the output of the subtraction counter with the output of said holding circuit thereby forming said ratio of maximum spike diameter to stem diameter.

27. The system of claim 24 wherein said logic means comprise a plurality of flip-flops receiving the output of said coincidence circuit means and delivering an output indicative that said ratio is within predetermined limits.

28. The system of claims 22 or 23 wherein said circuit means for calculating stem diameter comprises a counting circuit receiving data from said means for viewing, coincidence circuit means for determining coincidence between the value in said counting circuit and predetermined values, and logic means coupled to said coincidence circuit means for determining size of said elongated pieces.

29. The system of claim 28 wherein said means for storing comprises a memory circuit coupled to said logic circuit means.

30. The system of claim 29 wherein said memory circuit comprises a plurality of non-circulation shift registers receiving the output of said logic means, change-over switch means receiving the output of said shift registers and relay means to actuate said sorting station.

31. The system of claim 28 wherein said counting circuit comprises a pair of binary counters and said coincidence circuit means comprises a plurality of setting devices containing predetermined values of stem diameter, a plurality of EXCLUSIVE OR circuits receiving the outputs of said setting devices and binary counters respectively and an AND circuit receiving the outputs of said EXCLUSIVE OR circuits.

32. The system of claim 28 wherein said logic means comprises a network of AND circuits coupled to the output of said coincidence circuit means, a flip-flop network to store coincidence outputs of said coincidence circuit means and a series of AND gates coupling said flip-flop network to said means for storing.

33. The system of claim 28 wherein the circuit means to calculate spike maximum diameter comprises three logic means responsive to the output of said counting circuit, comparison circuit means and a holding circuit, whereby the output of said counting circuit during scan cycles of said means for viewing is successively compared with data stored in said holding circuit by said comparison circuit and the longer of the compared values stored in said holding circuit representing the maximum spike diameter for a respective elongated piece.

34. The system of claim 22 or 23 wherein said circuit means for calculating the length of said elongated pieces comprises a counting circuit receiving data from said means for viewing, coincidence circuit means for detecting coincidence between the value in said counting circuit and predetermined values, and logic means coupled to said coincidence circuit means for determining length of said elongated pieces.

35. The system of claim 34 wherein said logic means comprises a network of flip-flop receiving the outputs of said first and second AND circuits to produce a signal indicative of an elongated piece within said predetermined upper and lower limits.

36. The system of claim 34 wherein said counting circuit comprises 3 four-bit counters and said coincidence circuit means comprises first and second coincidence circuits, said first coincidence circuit comprising first setting means with a predetermined lower length limit and a first network of EXCLUSIVE OR circuits receiving the outputs of said first setting means and said counting circuit respectively to determine if the sensed length of said elongated pieces coincides with said predetermined lower length, said second coincidence circuit comprising second setting means with a predetermined upper length limit and a second network of EXCLUSIVE OR circuits receiving the outputs of said second setting means and said counting circuit respectively to determine if said sensed length coincides with said predetermined upper limit, and first and second AND circuits receiving the outputs of said first and second networks of EXCLUSIVE OR circuits.

37. The system of claim 36 wherein said coincidence circuits means comprises a third setting means containing a set value defining a predetermined dimension from the stem end of said elongated piece and a third network of EXCLUSIVE OR circuits receiving the outputs of said third setting means and said counting circuit respectively to provide a coincidence output representing a predetermined distance from said stem end on a respective elongated piece.

38. The system of claims 11, 12, 22, 23 or 24 wherein said elongated pieces comprise pieces of asparagus.

* * * * *